US005882107A

United States Patent [19]

Bornhorst et al.

[11] Patent Number: 5,882,107

[45] Date of Patent: Mar. 16, 1999

[54] COMPACT LUMINAIRE SYSTEM

[75] Inventors: James M. Bornhorst, Desoto; Douglas A. Hanson, Arlington; Timothy G. Huggins, Dallas; Timothy D. Stacy, Plano, all of Tex.

[73] Assignee: Vari-Lite, Inc., Dallas, Tex.

[21] Appl. No.: 558,454

[22] Filed: Nov. 16, 1995

[51] Int. Cl.[6] ..... F21V 9/00

[52] U.S. Cl. ..... 362/281; 362/283; 362/293; 362/284

[58] Field of Search ..... 362/293, 281, 362/282, 283, 284, 319, 322, 323, 324, 294, 373, 233

[56] References Cited

U.S. PATENT DOCUMENTS

| | | | |
|---|---|---|---|
| 4,112,486 | 9/1978 | Tovi . | |
| 4,392,187 | 7/1983 | Bornhorst . | |
| 4,600,976 | 7/1986 | Callahan | 362/277 |
| 4,602,321 | 7/1986 | Bornhorst . | |
| 4,980,806 | 12/1990 | Taylor et al. . | |
| 5,050,053 | 9/1991 | McDermott . | |
| 5,073,847 | 12/1991 | Bornhorst . | |
| 5,186,536 | 2/1993 | Bornhorst et al. | 362/283 |
| 5,333,102 | 7/1994 | Oberman et al. | 362/284 |
| 5,353,211 | 10/1994 | Merko . | |
| 5,402,326 | 3/1995 | Belliveau | 362/283 |

OTHER PUBLICATIONS

Catalog No. 148–2, 1994 Catalog of THK and NSK Co., Ltd., Japan.

*Primary Examiner*—Thomas M. Sember
*Attorney, Agent, or Firm*—Morgan & Finnegan LLP

[57] ABSTRACT

A highly compact, light weight automated luminaire is disclosed having a head unit mounted on a support structure which provides pan and tilt of the head unit. The latter includes beam controlling optics providing precise control over beam parameters including color. Groups of the instruments are remotely controlled from a digital controller such as a PC connected by cable or a wireless link to the instruments. The lights each include processors for processing comands from the digital controller. By reason of its light weight and compactness, the luminaire is suitable for many applications barred to conventional automated lighting fixtures.

14 Claims, 15 Drawing Sheets

COMPACT LUMINAIRE SYSTEM

TECHNICAL FIELD OF THE INVENTION

The present invention relates to lighting instruments for creating varied lighting effects in entertainment and architectural venues and in other environments including displays, studios, galleries, retail establishments and other sites which can be enhanced by lighting effects.

BACKGROUND

Dramatic lighting effects, once the exclusive province of theatrical venues has increasingly expanded to other sites. Expectations have grown in architectural lighting, in the illumination of displays and in other settings for a wide range of lighting moods and effects, both static and dynamic.

Remarkable advances in stage and tour lighting have been made over the past decade, exemplified by automated luminaires such as those described in U.S. Pat. Nos. 4,392,187; 4,602,321; 4,980,806; 5,073,847 and 5,186,536 (incorporated herein by reference along with the design applications of Timothy D. Stacey et al. assigned to the assignee of this application and filed concurrently herewith.

Indeed, luminaires embodying these advances have recently been honored with Emmy awards.

As the capabilities of these systems grew, so grew the applicability of their effects and the demand for their use. Low cost, compact and user-friendly luminaires that possess the powerful features of entertainment lighting, and support wide application, would enable expansion from the theatrical arena into the architectural and other fields.

Thus, it would be highly desirable to make the lighting effects created by theatrical instruments accessible to other applications, and indeed to any other environment which can be enhanced by creative lighting effects. However, a number of obstacles confront this endeavor. Automated luminaires are relatively large and for that reason are not suited for many applications. They are heavy as well, again limiting their utility in environments where only lighter objects can safely be mounted.

Installation, operation and service demands also create obstacles in applications where the requisite skills and/or resources are not available.

Finally, cost is a formidable factor which bars the current technology from many areas. Luminaires cost many thousands of dollars, putting them beyond the reach of many users who could otherwise exploit their impressive effects.

OBJECTS OF THE INVENTION

It is accordingly among the objects of the invention to provide a luminaire system for use wherever dramatic lighting effects are desired, which while capable of producing a wide range of visual effects, is light and compact; is easily installed, configured and operated; and is inexpensive enough to be affordable to establishments and enterprises of modest resources.

It is a further object of the invention to provide those attributes in a control system for controlling one or many luminaires.

It is commonly found necessary to compromise precision when modifying designs to make them smaller or less costly. However, in the control of color and position many applications are quite demanding both in respect of absolute values and in maintaining synchronization among luminaires.

It is accordingly a further object of the invention to provide a lighting instrument which is light-weight, compact and affordable, while also providing precision to satisfy the most demanding applications.

A further object of the invention is to make available to the user a wide choice of optional feature modules which are readily installable and at the same time, provide highly precise beam parameter control.

Another object of the invention is to provide a new and improved lighting instrument which exhibits smooth and precise placement of the light beam.

It is a further object of the invention to provide a new and improved lighting instrument which includes a beam parameter changing mechanism that employs a simplified, compact and inexpensive design accomplished without sacrificing precision.

Still another object of the invention is to provide a lighting instrument support that provides considerable 2-way articulation for the lighting head while taking up little space.

Another object of the invention is to provide a new and inexpensive lighting system controller that supports the requirements for, and demands of, a wide range of environments including entertainment, display and other venues that can exploit lighting effects.

SUMMARY OF THE INVENTION

According to one aspect of the invention, there is provided a multiple parameter lighting arrangement including a lighting instrument comprising a housing containing a light beam source and a color changing mechanism, the housing occupying a space of less than about 290 cubic inches.

Other aspects of this arrangement include:

(1) a remotely controlled movable supporting structure connected to the housing for varying the position of said beam.

(2) a plurality of the lighting instruments and a remote controller for controlling them.

The invention is further characterized in that the housing weighs less than about 36 ounces.

Another aspect of the invention involves a beam changing mechanism for use in a lighting instrument having a light beam source, the beam changing mechanism being located to intercept the light beam and further comprising a set of individually movable optical elements disposed radially of said beam with an element driving mechanism interconnecting the elements to coordinately move them to produce beam change; (e.g. color). The driving transmission includes a resilient section for minimizing backlash.

Yet another aspect of the invention relates to a beam changing mechanism for use in a lighting instrument having a light beam source, the beam changing mechanism being located to intercept said light beam and further comprising a set of individually movable optical elements of generally triangular or truncated shape. The elements are disposed radially of the beam in an array circumscribing the beam axis. An element driving mechanism interconnects the elements at their bases to coordinately move them to produce a change in beam property, the driving mechanism including a linear actuator, a ring gear rotated by the linear actuator, and spur gears attached to the elements and driven by the ring gear.

Also characterizing the invention is a lighting system including a multiple parameter lighting instrument, the instrument comprising a lamp head for generating a beam; a first support to which the head is rotatably mounted, the support including a motor and a driving mechanism connected to the head for rotating said head, the driving mechanism including a preloaded bearing assembly for reducing backlash in the driving mechanism.

BRIEF DESCRIPTION OF THE DRAWINGS

The present invention and its advantages may be understood by referring to the following detailed description of the preferred embodiment and the accompanying drawings, of which.

GENERAL DESCRIPTION

Figure 1:
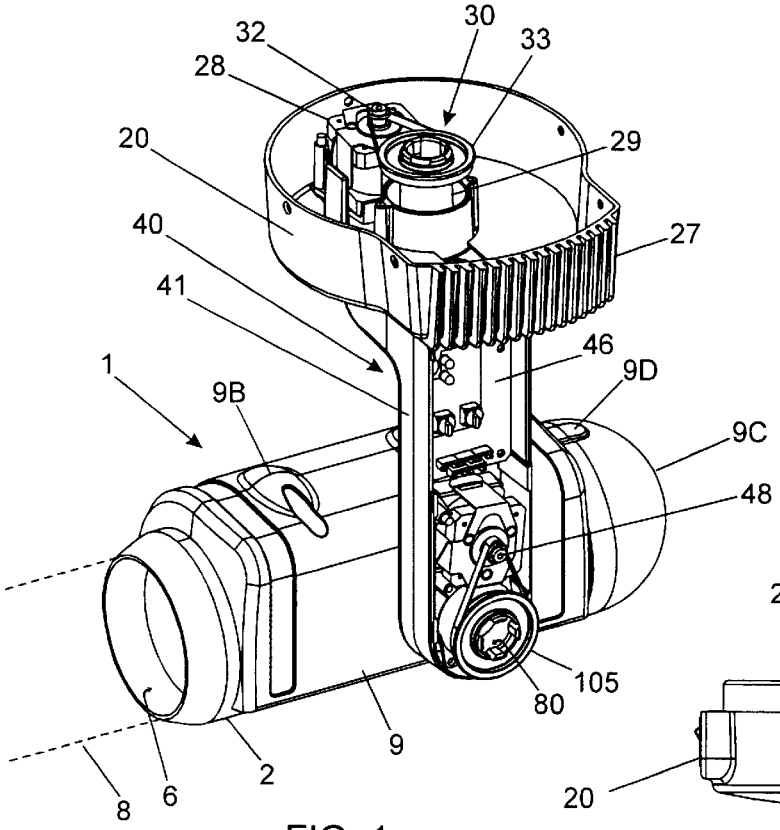
FIG. 1 is a perspective and external view of the preferred luminaire design.
Figure 1A:
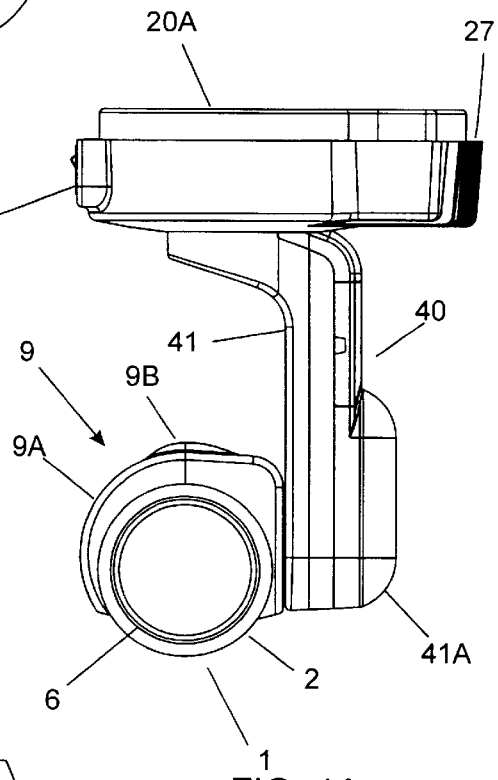
FIG. 1A is a front elevation view.

Referring to FIG. 1, the luminaire includes a lamp head 1. To achieve a compact configuration while obtaining maximum articulation, the mounting for the head 1 utilizes, instead of the conventional two arm yoke, a one armed asymmetrical design which is made more feasible in this case because of the lightness of head 1. Thus as seen in FIGS. 1, 1A, 14A and 14B the luminaire head 1 is pivoted on the arm 41 of a support assembly 40 which is rotated on an upper panning enclosure 20 containing control mechanisms and a power supply to be described. The enclosure 20 also includes a heat sink 27 and is capped by a cover 20*a*.

The axes of pan and tilt are preferably located in proximity to the center of gravity of the head 1.

Figure 2:
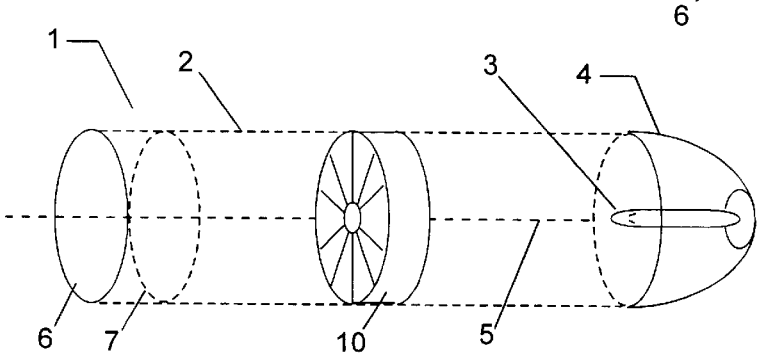
FIG. 2 is a schematic perspective view of a basic lamp unit.

Lamp head 1 includes a bulb 3, FIG. 2, and reflector 4 for forming a beam. The bulb is preferably a micropower discharge lamp manufactured by Philips and others. The beam from the reflector is processed by one or more optical bulkhead assemblies 10 and by another optical component such as a lens 7 after which it passes out of aperture 6.

The housing 2 of lamp unit 1 includes a cover assembly 9. Section 9*a* may be removed by removal of screws in connectors 9*b*. Back section 9*c* which includes vent holes (not shown) may be unlatched and separated by opening latches 9*d*.

Lamp unit 1 has a tilt tube 80 which extends into arm 41 and is locked to a driven pulley 105. A tilt stepper motor 56, mounted in arm 41 drives pulley 105 via drive pulley 48 and timing belt 47, thus causing tilting motions of lamp head 1.

Stepper motor 56 is controlled by step commands received from a programmable microprocessor (see FIG. 7) mounted on lamp control board 46 in arm 41. The microprocessor may be a MC68HC11K1, manufactured by Motorola.

The microprocessor, which receives remote commands from a controller described in a following section, also controls a pan stepper motor 28, mounted in pan assembly 30 in upper enclosure 20. The motor rotates arm 41 via driving pulley 32, a belt 31 and driven pulley 33 secured to a tube 29 extending from arm 41, thereby panning the head 1.

Most of the structural elements of the head 1 including the frame and housing are formed e.g. injection molded, of heat resistant plastic, e.g., Valox DR48, a G.E. PBT polyester. The yoke arm 41 and pan section 20 are preferably cast aluminum. The lamp head is about 11½ inches long and approximately 5 inches by 5 inches in cross section; it weighs approximately 36 ounces. The yoke arm 41 is about 9.25 inches high.

Enclosure 20 with its cover 20*a* is adapted to cooperate with various mounting fixtures for securing the luminaire to various surfaces including ceilings. It is approximately seven inches in diameter. For some installations, cover 20*a* may be secured to the mounting surface after which the rest of the assembly is fastened to 20*a*.

The housing 2 of lamp unit 1 includes a cover assembly 9. Section 9*a* may be removed by removal of screws in connectors 9*b*. Back section 9*c* which includes vent holes (not shown) may be unlatched and separated by opening latches 9*d*.

Further details of the panning and tilting system follow the explanation below of the optical system in lamp head 1.

Optical System

Optical processing of the beam is accomplished at least in part by one or more of the optical bulkhead assemblies 10, each of which is constructed utilizing a minimal number of individual pieces thus reducing the complexity found in other designs. At the same time it provides precise control of beam properties such as color.

The purpose of the bulkhead is to position a set of optical elements, e.g., filters, in the path of the beam of light in order to produce desired lighting effects by altering the color, or diffusing or dimming the light beam leaving the exit aperture.

To obtain consistent and repeatable results, and to obtain color in the luminaire that matches the color produced by other luminaires, the design herein removes substantially all backlash in the system and ensures that each filter remains in the correct alignment with respect to the rest of the group.

Figure 3:
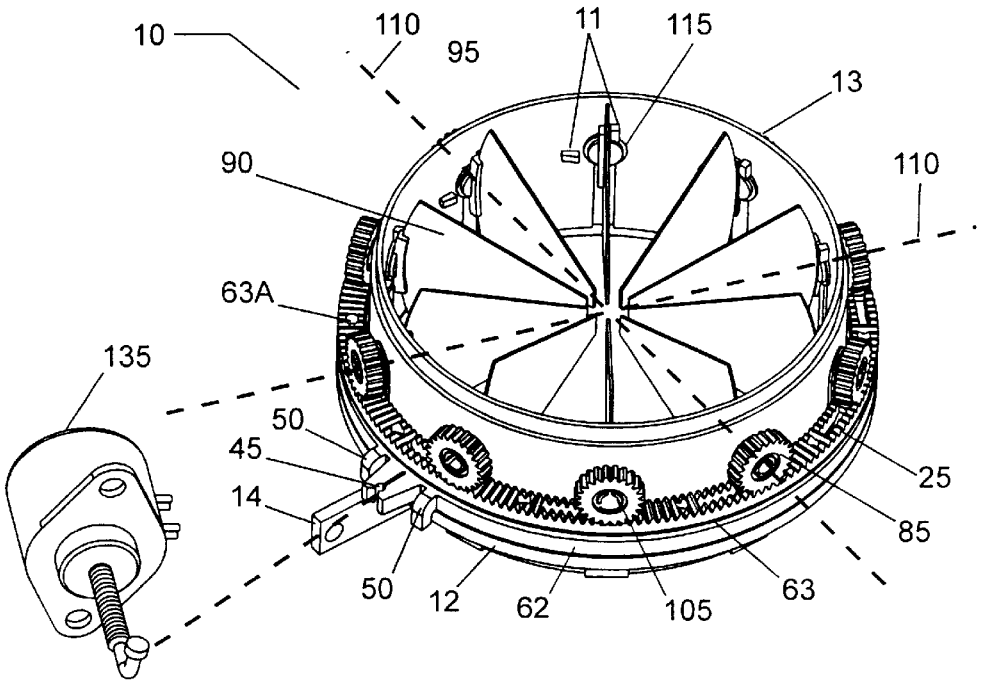
FIG. 3 is a perspective view of one embodiment of a beam changing mechanism.

To this end, and as seen in FIG. 3 and following, the assembly 10 includes a plurality of optical elements, e.g., coated glass dichroic color filter elements 90. These are deployed for simultaneous pivoting to intercept none, a part of, or substantially all of the light rays of the light beam. Substantially all of the rays are intercepted in the intermediate position between the fully closed position and the fully open position. It will be appreciated that embodiments of the invention can be constructed with various numbers of elements in the array.

A second option is to employ elements such as diffusion lens elements in lieu of color filters. Other embodiments of the invention can be constructed with still other optical elements chosen to alter the light originating from the light source for purposes of creating a visual effect. As noted hereinafter, all of these components can be simply snapped into place with proper registration insured.

Figure 3D:
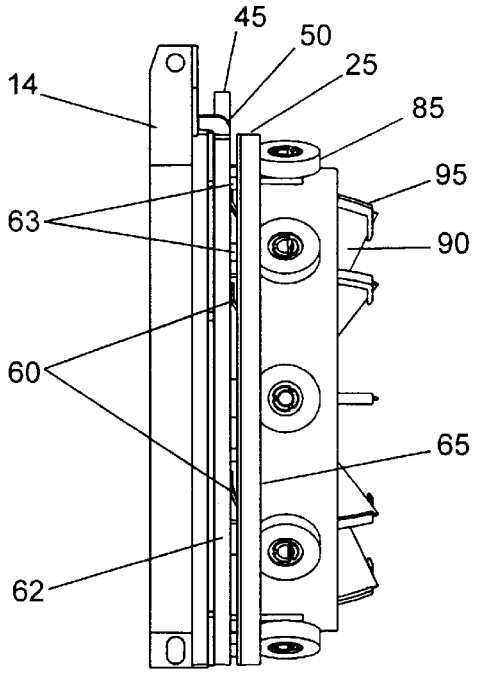
FIG. 3D is another side elevation view of the beam changing mechanism shown in FIG. 3.
Figure 3C:
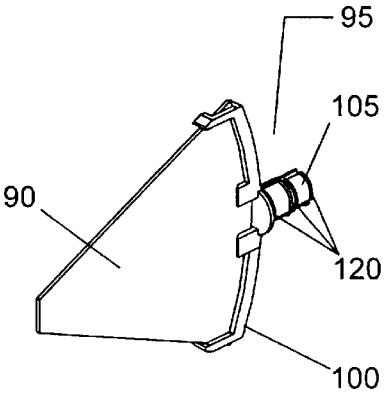
FIG. 3C is a perspective view of a filter assembly for use in the beam changing mechanism.
Figure 3B:
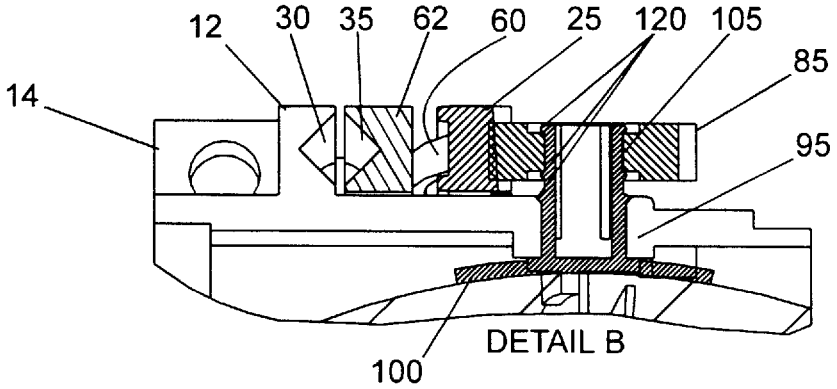
FIG. 3B illustrates the detail outlined in FIG. 3A.

As shown in FIGS. 3 and 3C, a filter carrier 95 holds each of the filter elements and integrates them into the bulkhead assembly. The filter carrier is characterized by a base 100 attached to the filter element by appropriate means, and a shaft 105 to provide support and rotation about respective axes 110 (FIG. 3) which intersect the lamp axis 5. The shaft 105 is manufactured to specifications which will allow a non-interference fit with a bulkhead hole 115 through which the shaft passes, and a friction fit with a spur gear 85 (See also FIGS. 3A, 3B and 3D) which mates with a rack ring 25. The latter serves as a pinion gear for purposes of transferring motion from the rack ring to the filter elements. A series of axially spaced rings 120 (FIGS. 3B, 3C) are molded into each shaft 105 for purposes of retaining the spur gear on the filter carrier 95 and retaining the filter carrier within the bulkhead wall 13.

The preferred embodiment of the color bulkhead assembly 10 contains a pair of filter stops 11, FIG. 3, for each optical element, the stops being located on the inner wall of the bulkhead 13 (the two stops within each pair are located at an approximate 90° angle from one another around the hole 115 through which the shaft 105 of the filter carriers 105 pass). The assembly also includes a bearing race flange 12 around its circumference, containing a molded "V" groove 30 (FIGS. 3A, 3B) on one face. Depending from two points on the opposite face are two diametrically opposed tabs 14 (FIG. 3) extending radially of the lamp axis. These opposing tabs serve as both mounting tabs and linear actuator stops.

The color bulkhead assembly 10 supports around the lamp axis 5, a race-ring 62 and the mating rack-ring 25 with gear teeth that engage and drives the spur gears 85.

The race-ring 62 also includes a plurality of locating pins 63 on the ring face opposite a "V" groove 35 in the opposing face of ring 62 (FIGS. 3, 3D). These are seated in alignment holes 63*a* situated around the face gear for purposes of registering the rack and race-ring.

The rack-ring 25 is further distinguished by a plurality of cantilevered springs 60 (FIGS. 3A, 3B, 3D) disposed circumferentially on the axial surface of the ring, facing ring 20. Backlash is removed from the gear mesh by providing these cantilevered springs which are molded in the rack ring and extend opposite to the gear teeth, thereby generating a side force, when assembled, against the spur gear.

The "V" grooved face 35 of the race-ring aligns with the "V" grooved face of the race Range 30. A bearing cage (not shown) containing a plurality of ball bearings resides in the bearing channel created by the two "V" grooves.

Figure 3A:
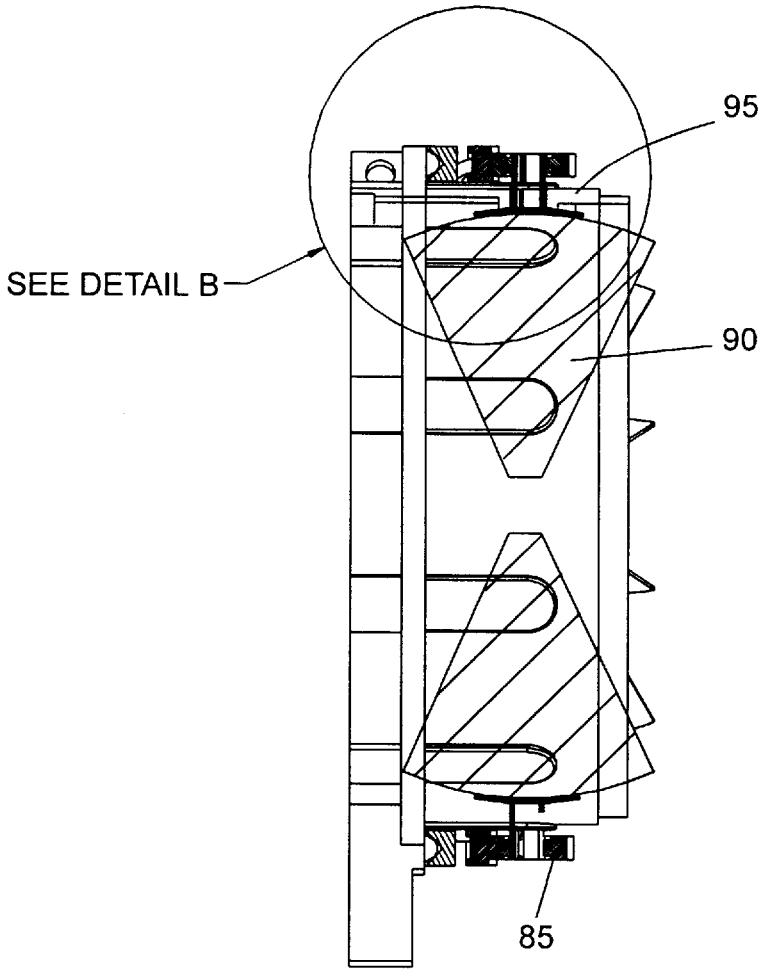
FIG. 3A is a partly cross-sectional side elevation view of the beam changing mechanism.

A lead screw clip 45, FIGS. 3A, 3D, extending radially of the lamp axis 5 is also located on the outer rim of the ring 62 and, as noted hereinafter, provides a coupling to a linear actuator for driving the rack-ring. Two linear actuator stop tabs 50 are located on either side of the lead screw clip 45 and extend radially outward from the optical axis 5.

Figure 4:
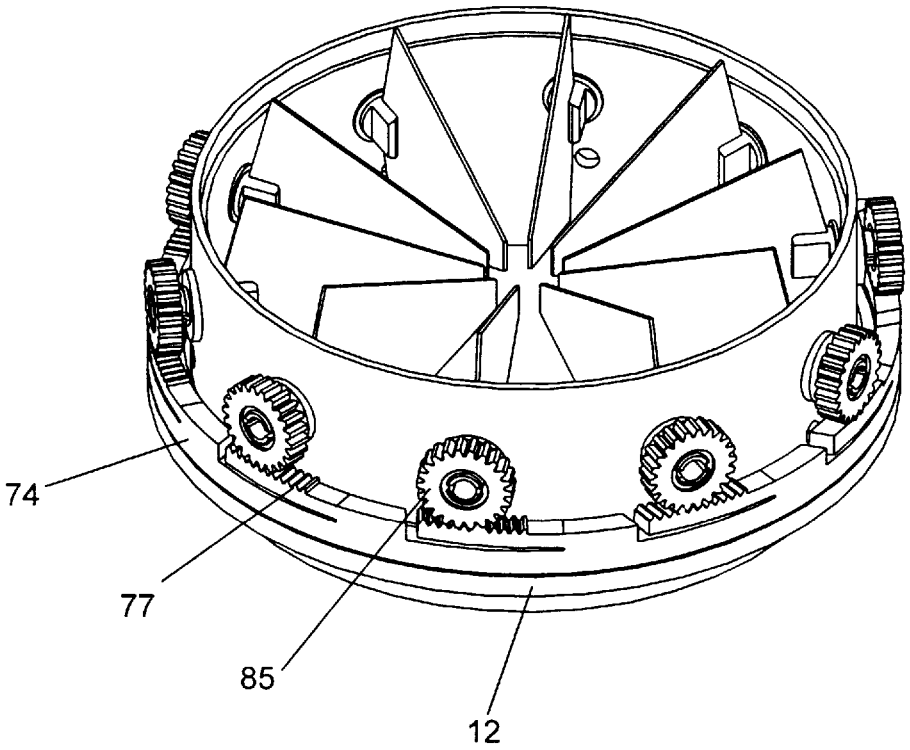
FIG. 4 is a perspective view of an alternative embodiment of the color changing mechanism.

As shown in FIG. 4, an example of an alternate embodiment of the color filter bulkhead is to combine the features of the race ring and the rack ring into a drive ring 74. The ring face that abuts the bearing race flange 12 may feature the previously mentioned "V" groove 30. The opposite face of the ring may bear the face gear 77 arranged in segments, each of which mates with the respective spur gear 85. To remove backlash between the spur gear 85 and face gear 77, this embodiment provides for cantilevering the face gear off of the drive ring to provide a resilient bias against the mating spur gear.

Figure 6:
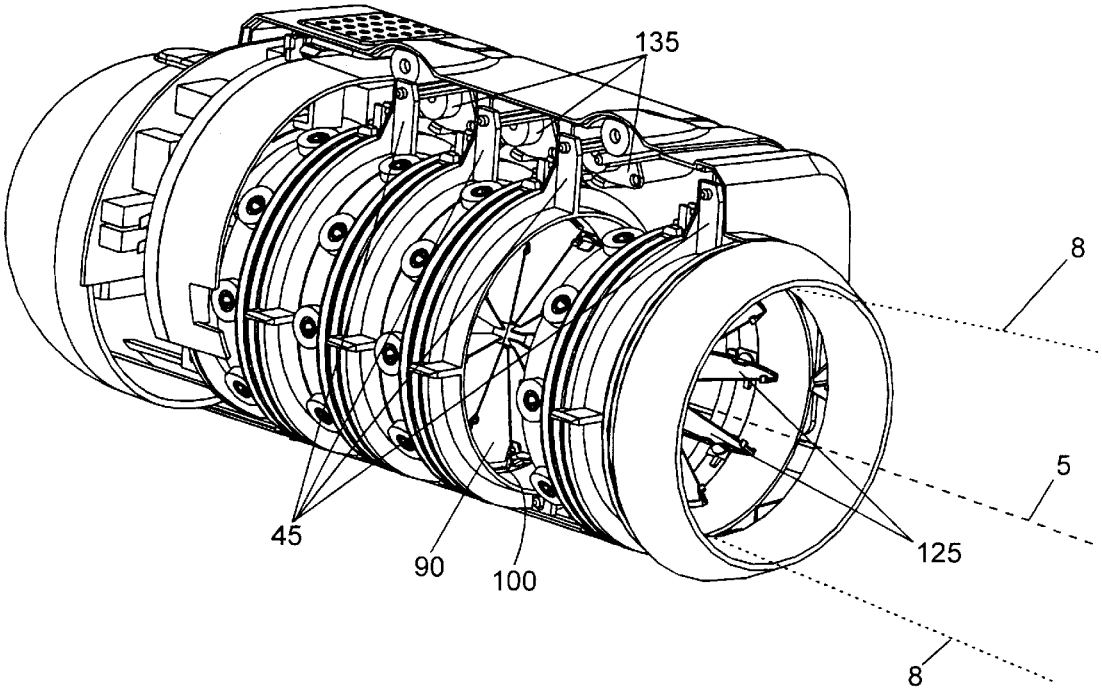
FIG. 6 is a perspective view of a lamp unit showing serial placement of multiple color changing mechanisms in a modular assembly configuration.

As illustrated in FIG. 6, the lamp head may incorporate a stack of the bulkhead assemblies 10. One or more may be comprised of filter elements 90 mounted in respective filter carriers 100 and supported for rotation about respective axes as previously described to provide a radial shutter-like arrangement when viewed along the axis 5. The filters illustratively comprise dichroic filters having identical optical characteristics. Each filter element is rotatable around an axis perpendicular to the light beam in order to vary the angle of incidence to thereby vary the hue of the light beam. Rotation of the filter elements also varies the white light transmitted past the filter elements in order to vary the saturation of the light.

To ensure repeatable color that matches that of companion lighting instruments, it is necessary that all filter elements attain identical angles of incidence to the light beam at any given time. The invention accomplishes these criteria by: (a) linking each filter assembly within a bulkhead to one another at their outer ends by the spur gears 85 which are interconnected by a suitable drive mechanism, such as the rack ring face gear 25, whereby all the wheels rotate simultaneously and through the same angle; (b) by removing backlash within the gear mesh via a positive side force applied from the rack ring 25 to the spur gear 85, preferably by means of the cantilevered springs 60, and (c) by providing features to calibrate and synchronize filter movement.

Calibration of the filter position is accomplished by providing an interference fit between the spur gear 85 and the filter carrier 100, which like a clutch, allows the spur gear to slip when the filter carrier hits the stop 11 at the end of travel. The gear will continue to slip until the linear actuator, or other source driving the rack ring, hits its stop. After the direction of the linear actuator is reversed, the filter carrier will move in the opposite direction to the other stop 11, calibrating the opposite end of travel. With this arrangement filter elements can be installed haphazardly but will align perfectly after the above described cycle.

When the filter elements are placed in their open position, the light beam 8 passes through the bulkhead essentially unaltered. A single filter bulkhead assembly may be plugged into the housing or a group of them in tandem may be installed to allow for alternate or combined effects when operated independently. A CYM subtractive arrangement using linkhead assemblies may be installed for example.

A linear actuator 135 (FIG. 3) is dedicated to each optical bulkhead 10 to act as a control mechanism for positioning elements within the light beam 8. Each linear actuator is situated such that its shaft is orthogonal to the rotating axis of the rack ring. As shown in FIG. 3, the linear actuator shaft is equipped with a 90° bend at its distal end allowing it to mate with the rack ring via the lead screw clip 45.

The rack ring lead screw clip 45 secures the linear actuator shaft preventing its rotation. The shaft therefore moves reciprocally when actuated, pushing and pulling the rack ring via the lead screw clip 45. The travel extremes of the rack ring actuator coincide with the open and closed positions of the filters in the bulkhead.

Although the movement of the linear actuator is essentially linear, and the movement of the rack ring is arcuate, the radius of the arc is less than the radial play in the linear actuators shaft to nut fit, therefore no binding occurs. A linear actuator motor suitable for this application is model 20841-12-016 from Haydon Switch and Instrument Inc., Waterbury, Conn., U.S.A.

By reason of their modular construction, the lamp head may be readily fitted with bulkhead assemblies of varying types.

Electronic control signals are supplied to the linear actuator motors for precise placement of the filters via a control system such as the open loop digital controller disclosed in U.S. Pat. No. 4,980,806.

Figure 7:
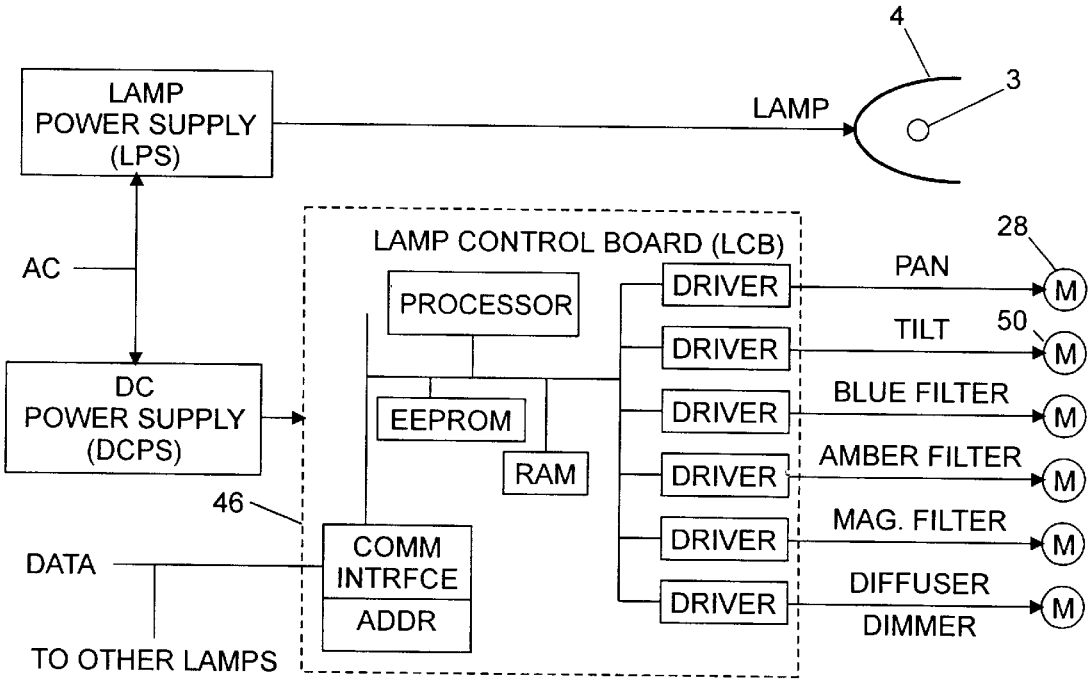
FIG. 7 is a block diagram of a lamp's control circuit suitable for controlling the automated lamp unit of FIG. 1 in response to remote commands.

Referring to FIG. 7, A.C. power is received via a power cord and supplied to both a lamp power supply (LPS) and a D.C. power supply (DCPS) where electronic power supplies provide appropriate power to operate the lamp and control circuitry. D.C. voltage from the D.C. Power Supply is fed into the Lamp Control Board (LCB) 46. The LCB receives command data addressed to the luminaire from a remote controller via a communication interface; the data is processed and the LCB forwards the appropriate drive signals to the appropriate stepper motor, M, via its driver. The motor moves the lamp in pan (lateral movement), tilt (vertical movement), or to control the hue and saturation or other parameters of the light by manipulating the inclination of the filter elements 90 within the light beam as previously disclosed.

During a calibration procedure the stepper motors are cycled to drive the optical elements 90 to their stops so that the microprocessor obtains output position information. Additional control system details are provided in a following section.

Lens Assembly

Figure 5:
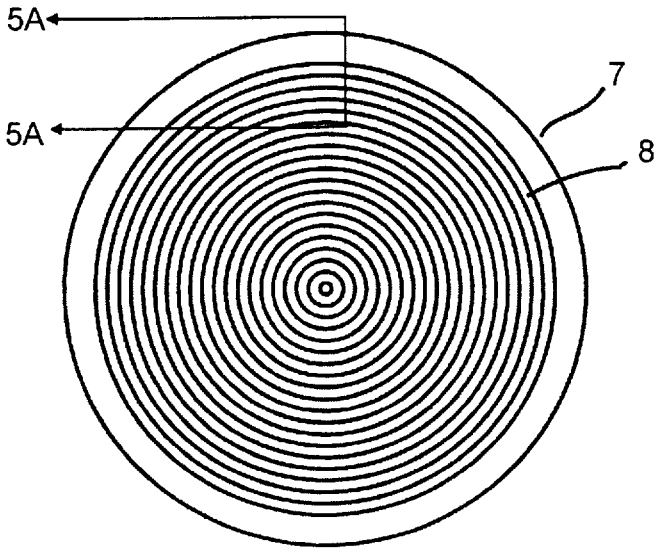
FIG. 5 is a view of a lens unit for incorporation in the luminaire.

FIG. 5 illustrates one type of lens 7 which may be plugged into the lamphead 1. The technique involves forming on a substrate elementary refractive surfaces which collectively shape the beam and which have individual shapes, orientation and distribution to achieve the desired beam properties.

This particular design is characterized by concentric planar wedges 8 that have been arranged so as to provide uniform distribution, and maximize the integrated energy output within the desired beam area.

Figure 5B:
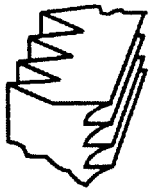
FIGS. 5B and 5C are fragmentary views of other lens configurations for use in the luminaire of FIG. 1.
Figure 5A:
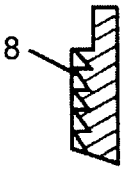
FIG. 5A is a cross sectional view taken along the lines 5A—5A of FIG. 5.
Figure 5C:
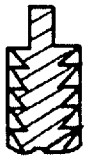
Figure 5F:
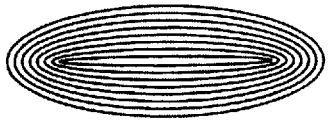
FIGS. 5D, 5E, 5F and 5G are plan views of various exemplary lens faces.
Figure 5D:
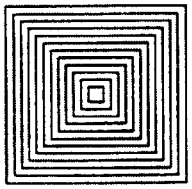
Figure 5E:
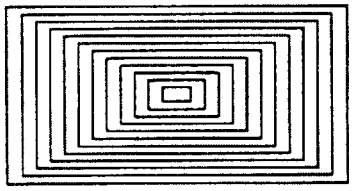
Figure 5G:
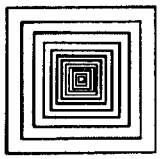
Figure 5H:
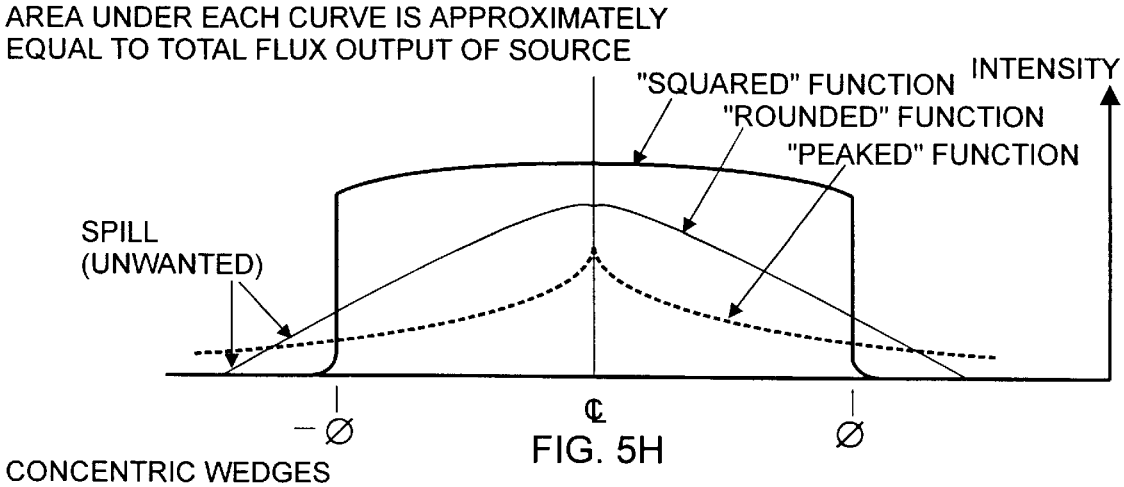
FIGS. 5H through 5L illustrate optical properties related to the lens of FIG. 5.

The object is illustrated in part in FIG. 5H where each of the curves represents the same output from a source but with 3 different types of beam patterns with the same beam angle. The area under each curve is the same. The more "square" the spread the more efficient is the system.

The technique utilized in lens 7 is to design the concentric wedge facets as successive tangent approximations to an aspheric curve in which the previous sagitta of arc have been subtracted. The sagitta of arc (z coordinate) is given by the relationship:

$$Z=[cr^2/(1+\sqrt{1-(1+k)C^2r_2})]+a_1r^1+a_2r^2+a_3r^3+\ldots a_nr^n$$

where c is the curvature, r is the radial coordinate in lens units, k is the conic constant, $a_1$ through $a_n$ are polynomial coefficients that describe the deviation from a sphere. The facets are then optimized with computer optimization to adjust for the approximations.

In the preferred embodiment, four commercially available software programs were used. Two mechanical design programs for data input and output. A lens design program optimizes input data in terms of geometric ray aberrations using damped least squares optimization techniques. A fourth program is used to model the complex geometry of arc, reflector, rms error of reflector, geometry of the luminaire structure, and provide the resultant data output for evaluation in terms of geometric rays, absorption, scattering and beam patterns in the near and far field. Evaluation of the data permits adjustments and re-runs of the program until the optimum wedge and facet design is achieved.

The use of these, or similar computer programs allow for a thorough analysis and precise customization of lens parameters such that a lens with the desired beam may be produced so balanced that little or no stippling is required to further blend the light zones.

Illustrating the type of results that can be obtained are the plots of FIGS. 5I–5L.

Figure 5I:
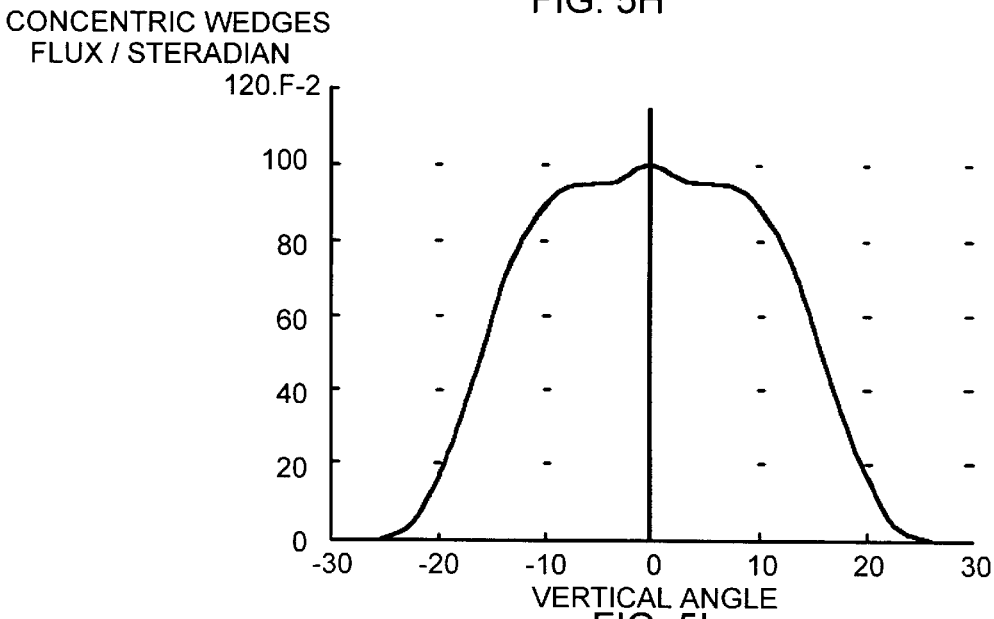

FIG. 5I gives a normalized plot of angle versus percent energy.

Figure 5J:
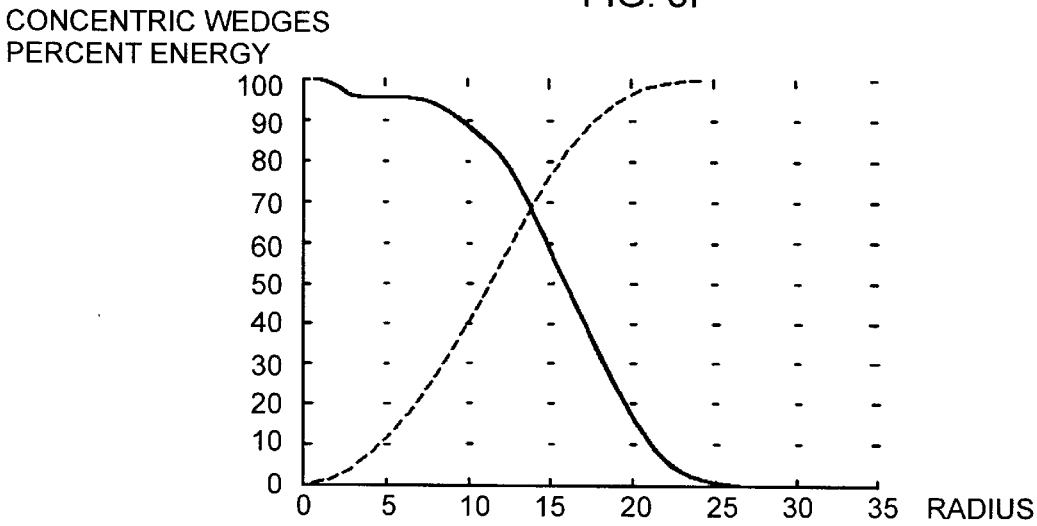

In FIG. 5J, the solid line shows the percent of energy and the dotted curve shows the integrated value for a given radius in degrees.

Figure 5K:
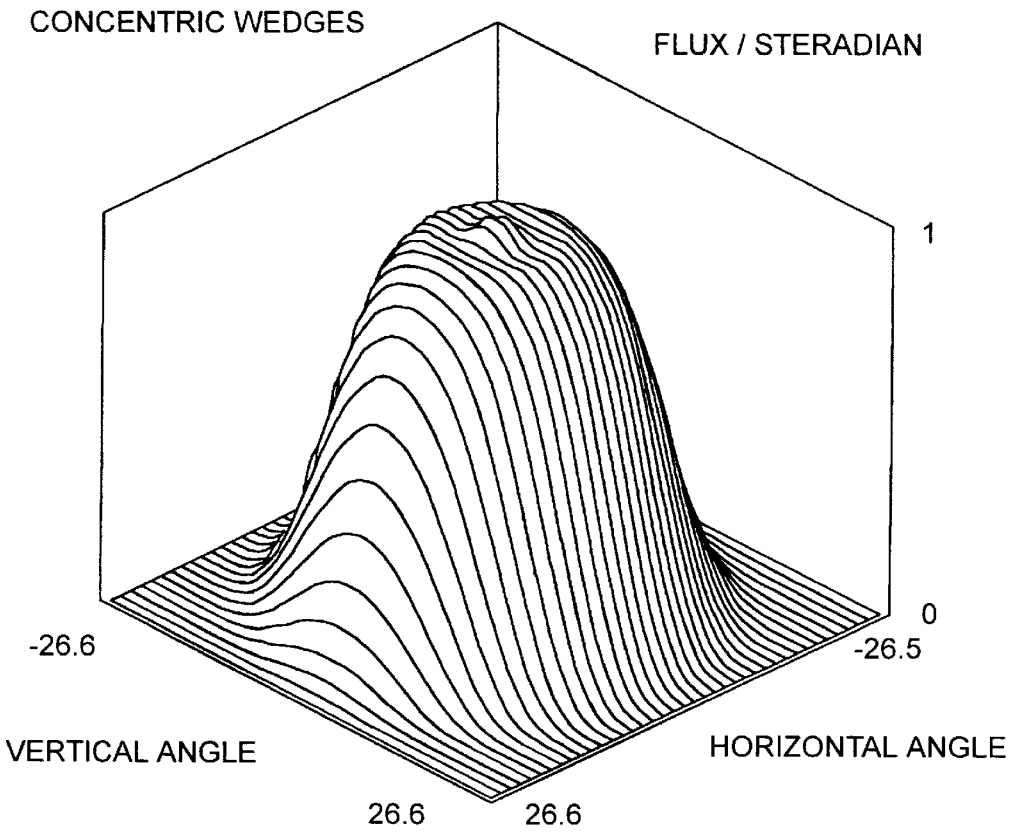

FIG. 5K illustrates a normalized isometric plot of flux/steradian.

Figure 5L:
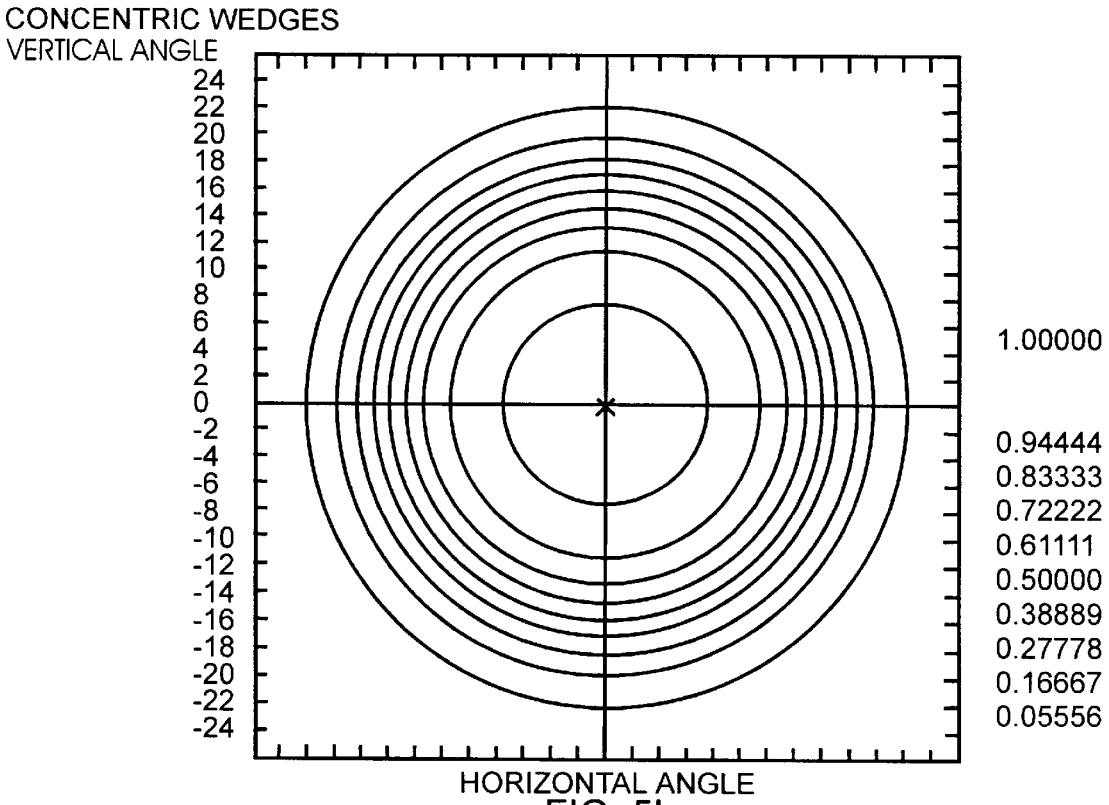

FIG. 5L gives a contour map in the horizontal plane for the light distribution in a flat plane perpendicular to the optical axis of the luminaire.

In the instant embodiment, the elementary refractive surfaces are planar. It should be appreciated however that non-planar facets would further allow different specific beam shaping, energy distribution, and possibly increased power output efficiency due to their ability to manipulate the light wavelets into diverging or converging bundles and superpose them into a single beam which provides other optional lighting parameters.

Planar facets allow a linear deviation over the extent of the facet. Consider a thin wedge receiving parallel incident monochromatic light. The parallel light emerges at a deviation $\delta=(n-1)\phi$ But if the refractive element has a curved shape, (arc of sphere, conic, a sphere, spline or any other non linear function), see e.g., FIG. 5B, this allows each element to contribute to the total composite beam in diverging (or converging) sections rather than just parallel beam sections. These shaped sections can be arranged radially, linearly, rectangularly, as a square, or elliptically.

As the light beam passes through the lens 7, the concentric surfaces 8 collect and redirect the light bundle's angle of inclination thus shaping a beam with an integrated energy that maximizes the light within the desired beam angle and minimizes the amount of lost or unwanted light in the "spill" area outside the desired beam.

In the preferred embodiment, the elements 8 are oriented on the exit side of the lamp. Optional embodiments allow for the elements 8 to be placed on the reflector side of the lens or on both sides of the lens 7, FIGS. 5B, 5C. As seen in FIGS. 5D–5F, the elementary surfaces may be posed as concentric, oval, or linear, or arranged in a square and may be non-linear (FIG. 5G). Non-geometric shapes may be employed as the contours and element distribution can be non-linear, asymmetric and discontinuous. Each embodiment provides for separate, specific, and unique effects due to the beam shaping attributes of the individual elements that are combined. As an example, a lens with an elliptical pattern of planar elements on one side would produce a different beam shape than a lens with linear, non-planar elements on both sides.

Pan and Tilt Details

The bearing system is designed to accommodate the asymmetrical mounting of head 1 on a single gimballing arm. Also, to achieve smooth and precise beam positioning, the system utilizes preloaded bearings in which a constant force is established against the bearings thus reducing play in the bearing movement. Reduction or elimination of free-play helps to maintain a constant load on the motor thereby increasing predictability of movement. If the bearings are not preloaded then, as the pan and tilt functions initiate movement from a stopped position, the motor experiences a reduced load while the play in the bearings is consumed. When the load is finally established, the motor movement will be temporarily impaired.

In an open-loop system such as the one utilized here, the control system is calibrated periodically, e.g. at initial power up. Thereafter the control system issues commands for movement, without feedback as to present location, based on the number of steps in the motor advance required to achieve the described position. In the preferred embodiment, each step is equal to 1.8°. Thus accuracy will degrade if free play is excessive. Freeplay in the drive system can result in misdirection of the light beam, and missteps in the movement which can result in unpredictable light sequences. One feature of the preferred embodiment is to utilize the pulley flanges for the combined purpose of providing spring action to preload the bearings and to keep the timing belts from coming off their pulleys.

Figure 8:
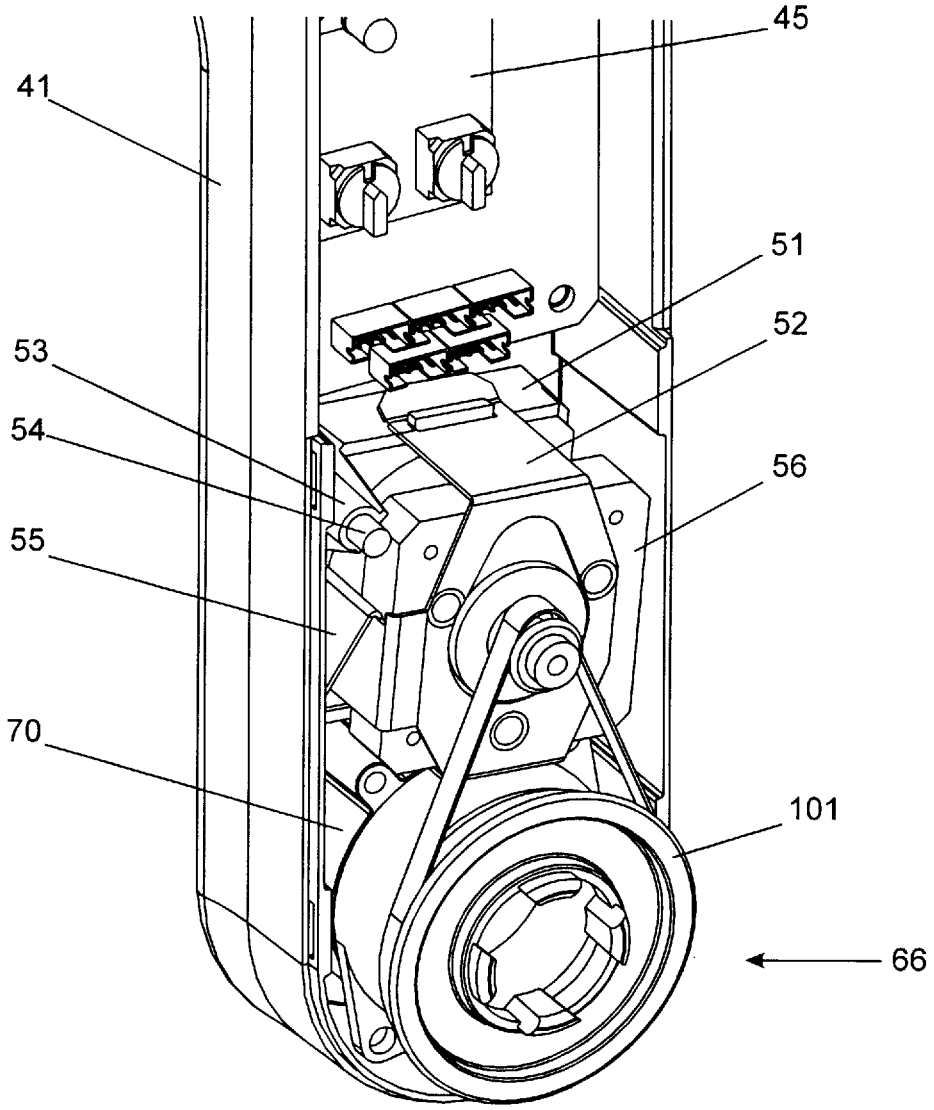
FIG. 8 is a perspective view of the yoke arm of the luminaire of FIG. 1.

FIG. 8 illustrates further details of the components of yoke arm 40. These include the stepper motor 56, the tilt bearing assembly 60, and the driven pulley 105. The stepper motor is secured to a plastic base plate 51 by metal strapping 52. The plastic base plate is equipped with a hollow cylinder 53 that slides over a post 54 molded into the yoke arm 41. Additional strapping 55 angles away from the motor and acts to spring load the motor against the wall of the yoke arm.

Fixed to the lower end of the yoke arm is a tube 70 having a passageway 75 (FIG. 9) formed centrally therethrough. The lamp head 1 is mounted to the yoke arm 41 using the header's pivoting tube 80 which rotates within the yoke arm tube 70 for pivotal movement about a nominally horizontal axis.

Figure 9:
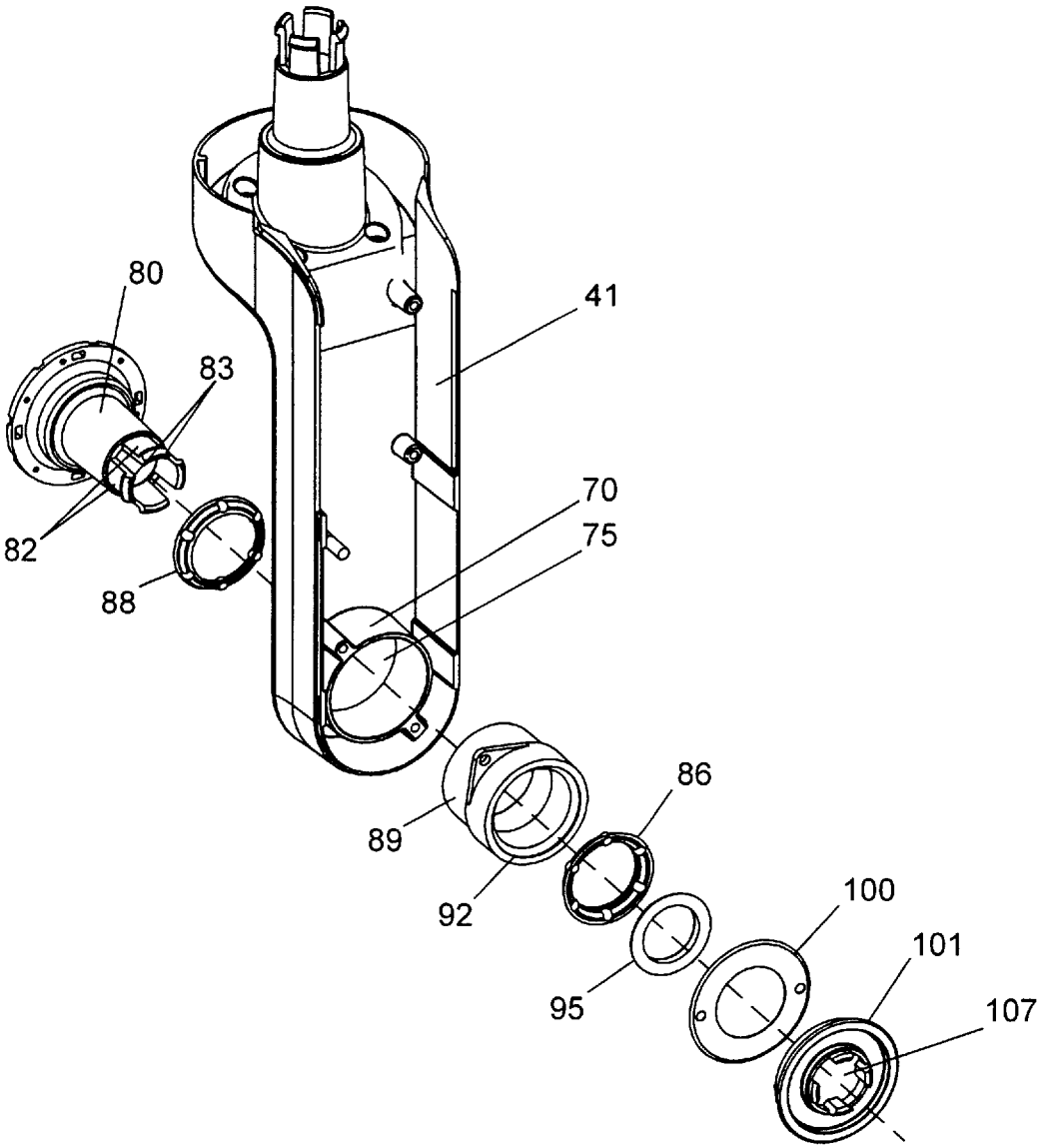
FIG. 9 is an exploded view of the tilt bearing assembly within the yoke arm.
Figure 10:
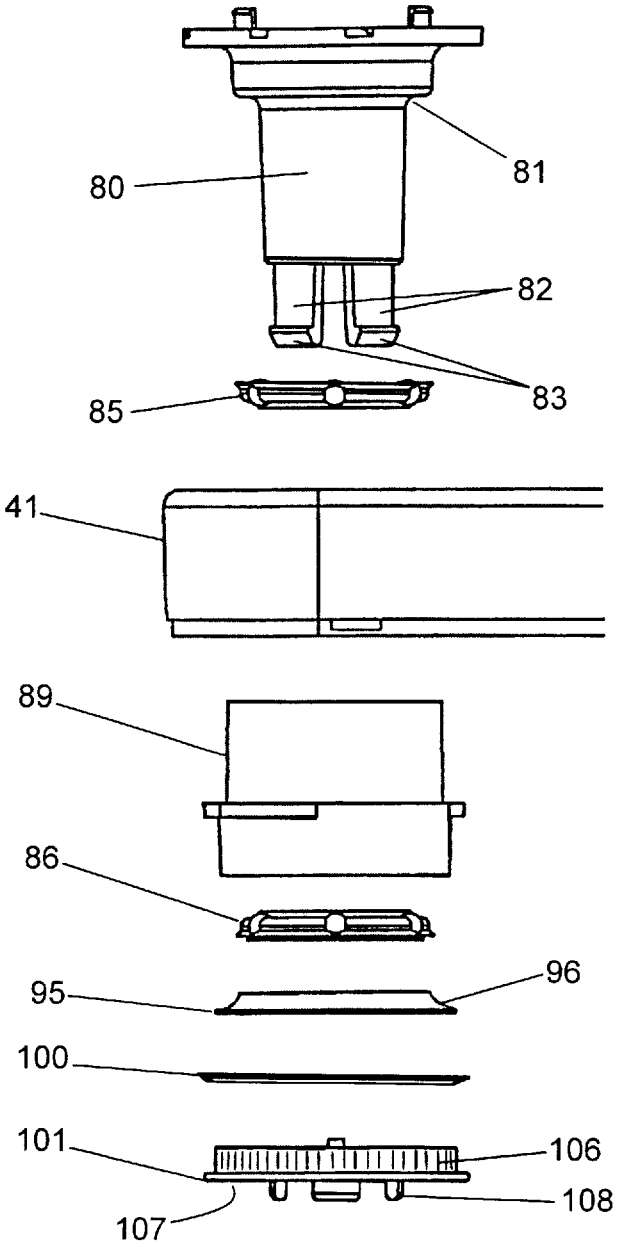
FIG. 10 is an exploded plan view of components of the tilt mechanism.
Figure 11:
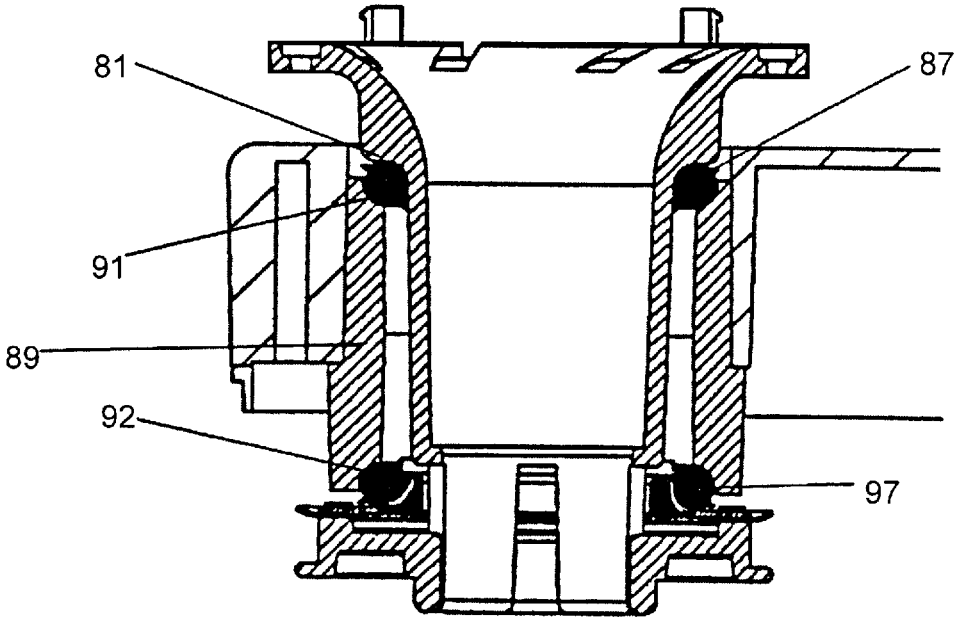
FIG. 11 is a plan and cross sectional view of the tilt tube and cooperating bearing assembly.
Figure 12:
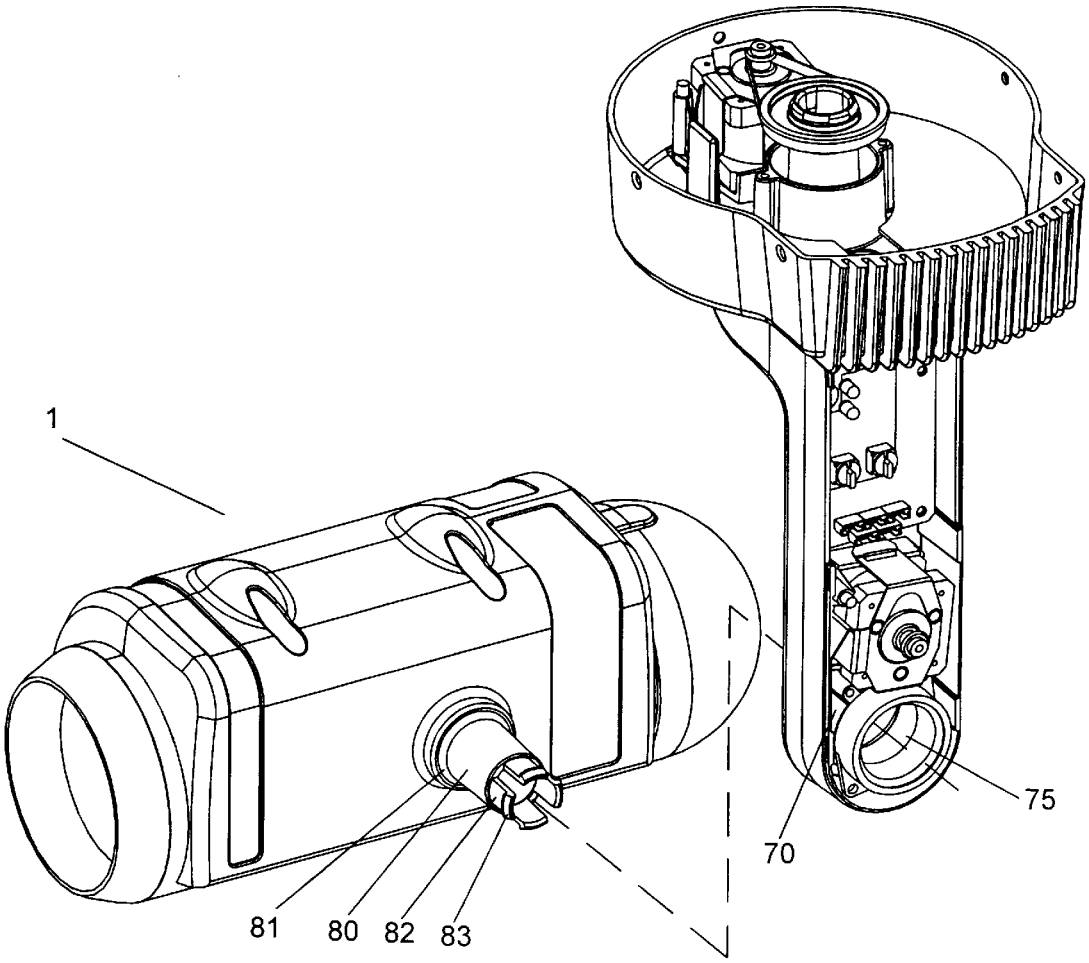
FIG. 12 is an exploded view of a lighting instrument illustrating the cooperation of the lamp unit (head) and its supporting member (yoke arm).

As seen in FIGS. 9–11, the tilt bearing assembly involves the tilt tube 80, two bearing cages 88 and 86, an outer race 89, a bearing sleeve 102, a driven pulley flange 108, and a driven pulley 101.

The tilt tube 80 is secured by heat staking to the inside wall of the lamp housing 2 and extends laterally from the lamp housing 2 through yoke arm tube 70. (Heat staking here consists of aligning the two plastic parts, using holes and alignment posts, and heating the inserted posts until the two plastic members fuse. Optional methods of containment may be used which employ glue or screws.

A bearing race 81 (FIG. 10) of tilt tube 80 cooperates with the inner surface of the yoke arm tube 70 as does the straight cylindrical section of 80 which resides within the horizontal passageway 75 of tube 70. Extending from section 80 are four extension fingers 82 with retaining flanges 83 for securing the final bearing assembly by means of spring tension.

The cylindrical outer race 89 with bearing races 91 and 92 on the inner lip of both ends (FIG. 11) is inserted between the yoke tilt tube 80 and the bearing sleeve 70. A bearing cage 88 containing a plurality of ball bearings is located in the raceway 87 formed by the tilt tube race 81 and the outer race 90.

The bearing sleeve 102 with a bearing race 96 combine with the remaining race 92 of the outer race 90 to form a second raceway 97. A second bearing cage 86, FIG. 10, resides in this raceway.

The driven pulley flange 108 which acts as a second wall of the driven pulley 101, performs the additional task of preloading the bearings in the bearing cages by means of spring tension. The driven pulley 101 includes the gear teeth 106 formed around its rim, a center hole 107 through which the extensions 82, 83 of the tilt tube 80 protrudes, and tabs 108 around the center hole which act as guides for the retaining flanges 83 of the tilt tubes extensions 82.

As the driven pulley 101 is pressed onto the tilt tube 80, the pulley flange 108 flexes to allow the tilt tube flanges 83 to snap over the driven pulley 101. The flexed pulley flange applies force against the bearing sleeve 102, which in turn provides a planetary transmission of force throughout the bearing assembly and places the bearings in a preloaded condition.

The dual function performed by the pulley flange 108, being a flange or side wall to the driven pulley 101 and concurrently providing the spring tension to preload the bearings in the bearing cages 85 and 86 contributes to the smooth and precise control over luminaire motion.

In this preferred embodiment of the invention, the pulley flange is constructed of spring steel, however it will be appreciated that any flexible material that stays within its elastic range (will not plastically deform), will not deform or compress under load, and will not creep, constitutes a suitable material.

As already noted, the pan mechanism 30 contained in the upper enclosure 20 is substantially identical in structure and function to that of the tilt mechanism.

Control System

Figure 13:
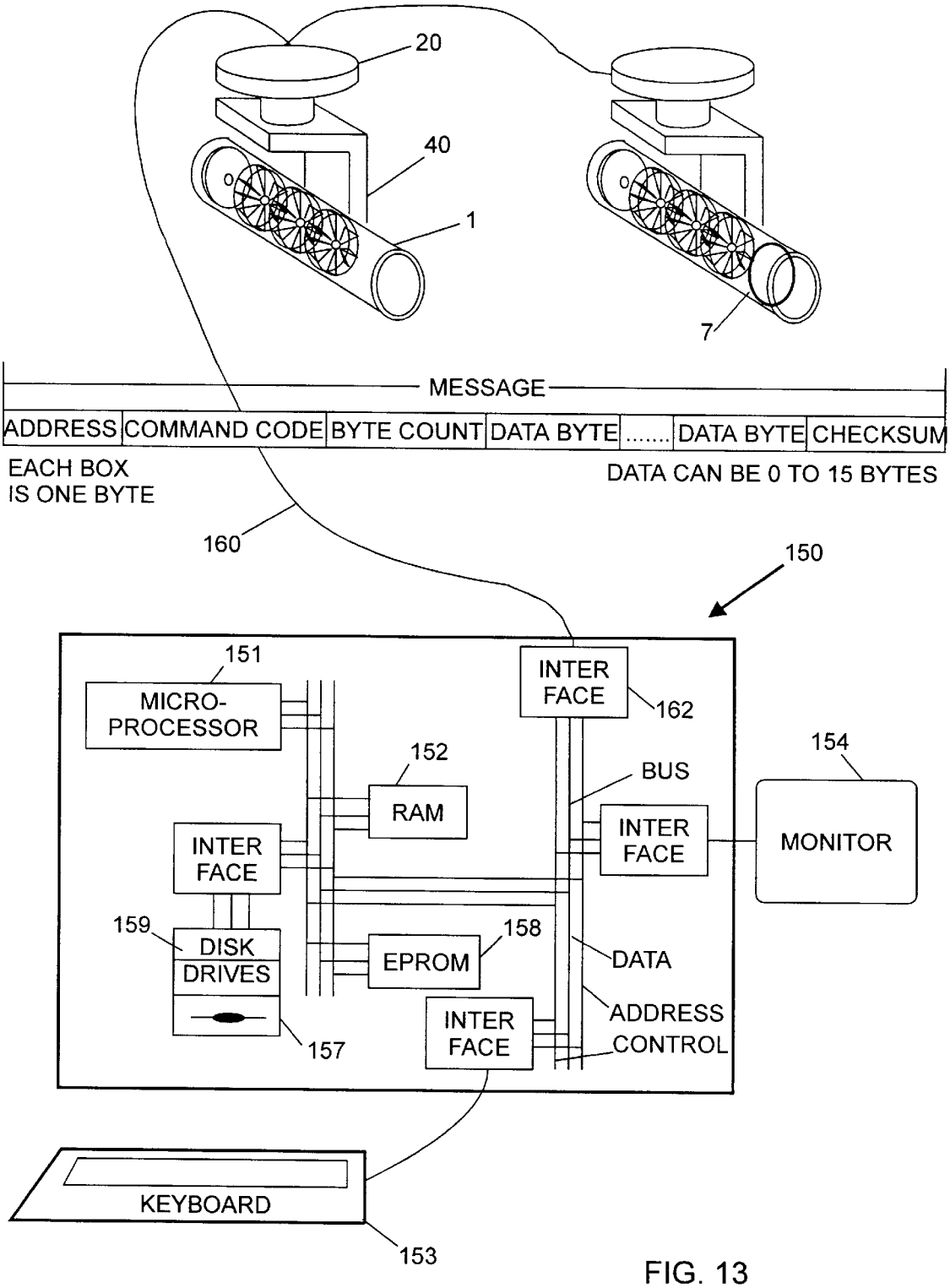
FIG. 13 is a block diagram of the control system for the automated lighting instruments of FIG. 1.
Figure 14A:
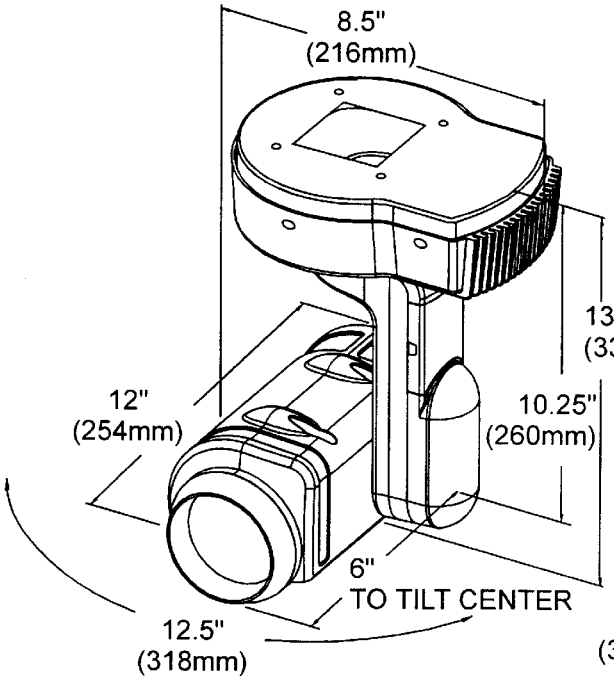
FIGS. 14A and 14B are perspective drawings illustrating overall features and dimensions of the luminaire.
Figure 14B:
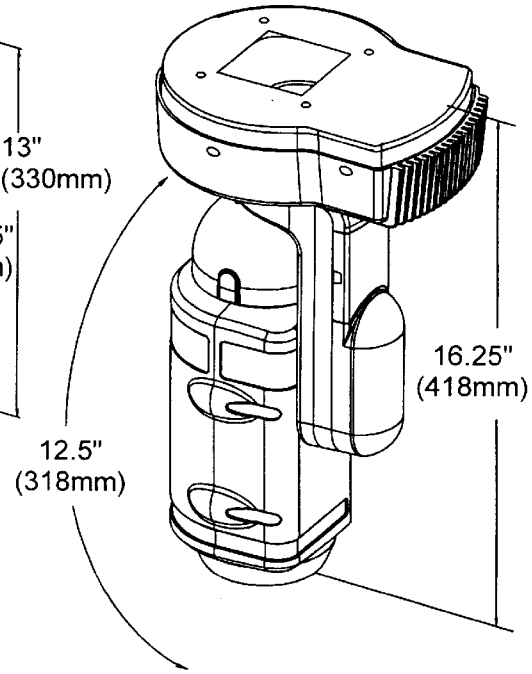

FIG. 13 illustrates the lighting control system which includes a personal computer 150 containing a central processing unit 151 with associated RAM 152, EPROM 158 and a data storage device such as a hard disk 159. The PC serves as the luminaire bus controller. It also includes one or more data input devices such as a keyboard 153 and floppy drive 157. A display unit 104 in the form of a monitor, and communication ports such as 162 are also provided. The PC communicates with a plurality of the lamp units 1 via communication interface 162 and a serial data transfer link which may be a cable assembly but for some applications may be a wireless link.

Data commands may be entered and stored in the computer by means of the keyboard 153 or a floppy disk inserted in drive 157. Subject to initiation of commands by the user, data is transmitted from the computer 150 through the communication port 162 to all connected lamp units 1 over the common link 160.

A broadcast command containing an address byte and command data is transmitted to the lamps. Each signal packet contains an address location for its destination lamp unit(s) 1 along with a command code designating the operation to be executed, a byte count, the actual data associated with the command, and a checksum for the message. The actual command data includes parameters to specify the desired azimuth and elevation; alignment position of color filters which set the desired color (hue and saturation); beam intensity; beam size and shape; and a timing value to indicate when the command is to be completed.

The microprocessor in the lamp unit, FIG. 7, interrogates each data transmission to determine if the command has addressed it. Once the lamp unit has matched its address to that of a data transmission, it will accept the data command and interpret the data for proper lamp response, e.g., parametric positioning.

By way of illustration, the lamp units microprocessor calculates in some situations the time required to execute a command based on the timing value received and its current status which has been stored internally. This calculated time to execute then controls the speed of the driving mechanisms to accomplish the command in the time allocated. Thus the lamp is directed for example to point to a certain location by a certain time and the lamp's processor controls the speed of execution to meet that command.

For the transmission of commands, the serial data line electrical specification illustratively follows the Electronic Industries Association (EIA) RS-485 standard with regard to signal levels, multi-drop configuration, a single differential pair signal path, half-duplex operation, etc.

An exemplary format, protocols and commands follow:

Data Byte Communication Protocol

Data bytes are transmitted in an asynchronous serial format. Each byte is transmitted as a data frame with the following communication protocol: 1 start bit, 8 data bits, 1 stop bit, no parity. The data is transmitted at a rate of 19200 baud in this embodiment.

Command Message Protocol

The basic format of communication between the luminaire bus controller and the luminaires is a command message. The bus controller sends command messages to the luminaires and the luminaires receive the messages and act accordingly. The luminaires do not send messages or respond back to the bus controller in this embodiment. Under normal operation there will be only one-way communication from the bus controller to the luminaires. The system is flexible enough however to accommodate modes where the luminaires respond back to the bus controller thus invoking two-way communication.

A message constitutes a series of data bytes preceded by an idle line condition (ones for at least one frame time) and followed by another idle line condition. The time between any two data frames of a single message is less than one frame time.

Each command message adheres to the following protocol (see also FIG. 13):

The first byte of the message is an address byte which designates the particular luminaire or zone the message is intended for.

The second byte of the message is a command code to designate the particular operation for the luminaire to execute.

The third byte of the message is a count of al the bytes in the message.

All bytes following the byte count and before the last byte of the message are the data associated with that particular command.

The final byte of the message is an eight bit checksum of the message.

Address

The address byte designates a particular luminaire or zone address. The most significant bit (MSB - bit 7) of the address byte designates if this is a zone address or a luminaire address. A one in bit 7 designates a zone address and a 0 in bit 7 designates a luminaire address. Luminaire addresses are illustratively limited to the range of 1 to 61. The zone addresses in this embodiment range from 0 to 126. Messages addressed to a luminaire are single station messages and messages addressed to a zone are zone broadcast messages (intended for a zone or group of lights). The remaining 7 bits of this byte correspond directly to the luminaire or zone address. A one (1) means luminaire or zone address number 1, a two (2) means luminaire or zone address number 2, a three (3) means luminaire or zone address number 3, . . . and so on through address 126 (or 127). An address byte of value 255 (all bits are ones, 0×FF) designates a global broadcast message intended for all luminaires on the network. An address byte of value 0 designates a message intended for the luminaire bus controller and is used in special modes when the luminaire may be allowed to respond back to the controller.

Command Code

The command code byte designates the particular operation the controller is commanding the luminaire to execute. These command codes are the instruments for remotely controlling the luminaires. The controller uses these command codes either individually or a series of them to control the luminaire as desired. Table I lists the command code names with their corresponding identifier and hex code useful for one embodiment of the invention. The command codes are represented in the command code byte by their hex code as shown in Table I. There are a total of 23 command codes represented hexadecimally as DX00, 0X01, . . . 0×16. The are described below:

Select Luminaires

This command is transmitted by the controller when addresses are selected by a user. A luminaire must be selected to respond to several other command codes. This command will generally be sent as a global broadcast message (address of 0×FF). There will be eight (8) data bytes following the command code to designate the currently selected luminaires. Each bit of the eight bytes represents an address number. The MSB of data byte 1 represents address 1, the LSB of data byte 1 represents address s8, the MSB of data byte 2 represents address 9, . . . and so on through address 61. The last 4 bits of data byte 8 are not used. A logic one (1) in the bit means the address is selected and logic zero (0) means the address is not selected.

Set Zone

This command tells the luminaire which zone number that it resides in. After receiving this command the luminaire will then respond to broadcast commands for the zone number passed to it by this command. The luminaire will store the zone number passed in EPROM. If a zone number of zero is sent, the luminaire will erase any zone number stored and will no longer respond to any broadcast zone commands. A single data byte will follow this command. The data byte will contain the zone number (0–126).

Set Address

This is a special command that can be used to set the address of a luminaire. After receiving this command the luminaire will then respond to commands for the address passed to it by this command. A single data byte follows this command. The data byte contains the address (0–126) for that luminaire. The luminaire will store the address in EPROM. The luminaire will then respond to commands for that address rather than the physical address setting on the luminaire. If an address of zero is sent, the luminaire will erase any address stored and will then respond to commands for its physical address setting.

Set Independent Mode

This command sets the selected luminaires in independent mode or removes them from independent mode. When in independent mode a luminaire will only respond to manual move commands and ignore preset commands received. This command will generally be sent as a zone broadcast message since a luminaire must be selected to respond. A single data byte follows this command and designates whether the selected luminaires are removed from independent mode (0) or placed in independent mode (1).

Absolute Manual Move Command

This command instructs the selected luminaires to make a manual move of one of their mechanisms to an absolute position. This command is generally sent as a zone broadcast message since a luminaire must already be selected to respond. Two data bytes follow this command. The first data byte is a device code designating the device being commanded. The second and third data bytes represent the integer value of the absolute position commanded for that device.

Relative Manual Command

This command instructs the selected luminaires to make a manual move of one of their mechanisms by a specified amount. This command will generally be sent as a zone broadcast message since a luminaire must already be selected to respond. Two data bytes will follow this command. The first data byte is a device code designating the device being commanded. The second and third data bytes represent the integer value of the relative position commanded for that device.

Set Function Filter

This command instructs selected luminaires to set their function filter. The function filter determines which functions (Intensity, Color, etc.) of a preset will be performed when recalling a preset. This command is generally sent as a zone broadcast message since a luminaire must already be selected to respond. A single data byte follows this command. Bits 0 through 3 of this data byte contain the function filter. Bit 0 is for the beam function, bit 1 for the color, bit 2 for the focus (pan and tilt), and bit 3 the intensity. A one in the bit for a function turns the function on, a zero turns the function off.

Set Function Time

This command instructs selected luminaires to set their function times. These function times are part of the presets that can be stored. This command is generally sent as a zone broadcast message since a luminaire must already be selected to respond. Three data bytes follow this command. The first byte is a function filter which determines the function times to be updated, the second byte contains the function time, and the third byte contains the scale code of the function time. The function filter byte uses bits 0 through 3. Bit 0 is for the beam function, bit 1 for the color, bit 2 for the focus (pan and tilt), and bit 3 the intensity. A one in the bit for a function means set the function time for that function to the value sent while a zero means do not set the function time.

Set Delay Time

This command instructs selected luminaires to set their delay time. The delay time is part of the presets that can be stored. This command is generally sent as a zone broadcast message since a luminaire must already be selected to respond. Two data bytes will follow this command. The first byte contains the delay time and the second byte contains the scale code of the delay time.

Set Delay Filter

This command instructs selected luminaires to set their delay filter. The delay filter determines which functions (Intensity, Focus, Color, and Beam) of a preset will use the delay time stored when recalling a preset. This command will generally be sent as a zone broadcast message since a luminaire must already be selected to respond. A single data byte will follow this command. Bits 0 through 3 of this data byte contain the delay filter. Bit 0 is for the beam, bit 1 for the color, bit 2 for the focus (pan and tilt), and bit 3 the intensity. A one in the bit for a function turns the delay on, a zero turns the delay off.

Timing Enable/Disable

This command instructs the selected luminaires to either enable or disable function and delay times when recalling presets. This command is generally sent as a zone broadcast message since a luminaire must already be selected to respond. One data byte will follow this command. A data byte of one (1) will indicate enable timing or a data byte of zero (0) will disable timing.

Set Timing Factor

This command sets the timing factor for selected luminaires. This command will generally be sent as a zone broadcast message since a luminaire must already be selected to respond. A single data byte will follow this command. The data byte will be an integer value ranging from 0 to 200. All timing values (function and delay) will be adjusted by the formula:

$$\text{timing value used} = \text{timing value stored} * \text{timing factor}/200;$$

Download Preset Data

This command sends luminaires their data for the next preset to be executed. Twelve bytes of data follow this command. The data bytes contain preset position and timing information for all of the luminaire's devices. Only luminaires present in the preset will be sent preset data. After receiving the preset data the luminaire will store the data and wait to receive an execute preset command. It will take no more than about 0.5 seconds to send present data if every luminaire's preset data is sent. The execute preset command will allow all luminaires to begin preset execution at the same time.

Execute Preset

This command instructs the luminaires to now execute the preset data just received. This command is generally sent as a zone broadcast message. No data bytes follow this command.

Store Luminaire Preset

This command instructs the selected luminaires to store their current device positions and function times as a luminaire resident preset. This command will generally be sent as a zone broadcast message since a luminaire must already be selected to respond. One data byte follows this message. The data byte contains the present number to store. The preset number will range from 1 to 50.

Delete Luminaire Preset

This command instructs the selected luminaires to delete the luminaire resident preset specified. This command is generally sent as a zone broadcast since a luminaire must already be selected to respond. One data byte follows this message. The data byte contains the preset number to delete. The preset number will range from 1 to 50.

Recall Luminaire Preset

This command instructs the selected luminaires to recall a luminaire resident preset. This command is generally sent as a zone broadcast message since a luminaire must already be selected to respond. One data byte follows this message. The data byte contains the preset number to recall. The preset cue number will range from 1 to 50. When presets are recalled and executed by the luminaire the previous function filter data, timing enable/disable data, etc. is used to mask the preset.

Execute Diagnostic Test

This command instructs the selected luminaires to execute a diagnostic test. This command is generally sent as a zone broadcast message since a luminaire must already be selected to respond. One data byte will follow this message. The data byte will contain the diagnostic test number to execute.

Stop Diagnostic Test

This command instructs the selected luminaires to stop execution of any diagnostic tests. This command is generally sent as a zone broadcast message since a luminaire must already be selected to respond. No data bytes will follow this message.

Flip

This command instructs the selected luminaires to move their pan and tilt positions to the corresponding pan and tilt positions which are the same distance from the center point of their range of rotation but in the opposite direction. This command is generally sent as a zone broadcast message since a luminaire must already be selected to respond. No data bytes will follow this command.

Reset/Recalibrate

This command will cause the previously selected luminaires to recalibrate. This command will generally be sent as a zone broadcast message since a luminaire must already be selected to respond. No data bytes will follow this command code.

Periodic Console Alive Message

This message will be sent out approximately every 10–30 seconds as an acknowledgement to the luminaires that a controller is on-line and active. If a luminaire does not receive this message for more than 120 seconds it will become inactive and not respond to commands until this message is received again. This command will always be sent as a global broadcast message. No data bytes will follow this command code.

Byte Count

This byte is a number which represents the count of all the data bytes in this message including the address (1), command code (1), byte count (1), data bytes (0–12), and the checksum (1).

Data Bytes

The number of data bytes for each message range from 0 to 15 bytes depending on the particular command code sent. The number of data bytes and their content for each command code is described in the preceding command code descriptions.

Checksum Byte

The final byte in each message will be a checksum of all bytes in the message except for the checksum byte.

The luminaire system herein disclosed is of such a compact and lightweight design as to make it useful for many applications unsuited to luminaires of conventional size and weight such the Vari-Lite VL5 and VL6. The latter weighs 22 lbs. and occupies a space of approximately 25 inches by 16 inches by 9 inches.

The VL5 weighs 25 lbs. and occupies a space of about 27 inches by 16 inches by 10 inches. As noted above the luminaire disclosed herein is substantially smaller and lighter.

What is claimed is:

1. A multiple parameter lighting arrangement including a lighting instrument comprising a housing containing a light beam source and a color changing mechanism, said color changing mechanism; includes a set of individually movable optical elements disposed radially about a light beam emanating from said light beam source; said optical elements being interconnected for coordinate movement with an element driving mechanism having a clutch characteristic; said elements also being associated with sets of stops whereby cycling said driving mechanism automatically registers said elements.

2. A multiple parameter lighting arrangement including a lighting instrument comprising a housing containing a light beam source and a color changing mechanism, and a remotely controlled movable supporting structure connected to said housing for varying the position of said beam; said movable supporting structure includes a motor, rotational bearings, and a driving transmission for moving said housing, said driving transmission including a pulley system incorporating resilient means for preloading said bearings.

3. A color changing mechanism for use in a lighting instrument having a light beam source, said color changing mechanism being located to intercept said light beam and further comprising a set of individually movable optical elements disposed radially of said beam; an element driving transmission interconnecting said elements to coordinately move them to produce color change; said driving transmission having a resilient section disposed circumferentially on a driving component and engaging said driving component with at least one driven component by applying a side force against said driven component.

4. A color changing mechanism for use in a lighting instrument having a light beam source, said color changing mechanism being located to intercept said light beam and further comprising a set of individually movable optical elements disposed radially of said beam; an element driving transmission interconnecting said elements to coordinately move them to produce color change; said driving transmission having a resilient section engaging a drive component with at least one driven component, said driving transmission including a clutch section and said color changing mechanism also including stops associated with said elements whereby cycling said driving transmission automatically registers said elements.

5. A beam changing mechanism for use in a lighting instrument having a light beam source, said beam changing mechanism being located to intercept said light beam and further comprising a set of individually movable optical elements of generally triangular or truncated shape having a base side and at least two other sides, said elements being disposed radially of said beam in an array circumscribing said beam axis; an element driving transmission interconnecting said elements to coordinately move them to produce a change in beam property; said driving transmission including a linear actuator, a ring gear rotated by said actuator, and spur gears attached to said elements and driven by said ring gear; said driving transmission including resilient means disposed circumferentially on said ring gear and providing a side force against said spur gears for maintaining engagement of said ring gear with said spur gears.

6. A beam changing mechanism for use in a lighting instrument having a light beam source, said beam changing mechanism being located to intercept said light beam and further comprising a set of individually movable optical elements of generally triangular or truncated shape having a base side and at least two other sides, said elements being disposed radially of said beam in an array circumscribing said beam axis; an element driving transmission interconnecting said elements to coordinately move them to produce a change in beam property; said driving transmission including a linear actuator, a ring gear rotated by said actuator, and spur gears attached to said elements and driven by said ring gear; said driving transmission including resilient means for maintaining engagement of said ring gear with said spur gears, said beam changing mechanism including stops associated with said elements and said element driving transmission including a clutch characteristic whereby cycling said driving transmission to engage said stops automatically registers said optical elements.

7. A lighting system including a multiple parameter lighting instrument, said instrument comprising a lamp head for generating a beam; a first support to which the head is rotatable mounted, the support including a motor and a driving transmission connected to said head for rotating said head, said driving transmission including a preloaded bearing assembly for reducing backlash in said driving transmission, said motor comprising a stepper motor and said driving transmission including a pulley system incorporating resilient means for providing said preloading.

8. A lighting system including a multiple parameter lighting instrument, said instrument comprising a lamp head for generating a beam; said head including color changing means having a set of individually movable optical elements disposed radially of said beam for changing the color of said beam; said color changing means including a driving transmission interconnecting said elements to coordinately move them to produce color change, said transmission having a clutch characteristic and stops limiting rotational movement of said optical elements for calibrating said color changing means by cycling said driving transmission to automatically register said optical elements.

9. A lighting system including a multiple parameter lighting instrument, said instrument comprising a lamp head for generating a beam; said head including color changing means for changing the color of said beam; said color changing means including resilient means disposed circumferentially about a driving component and engaging said driving component with at least one driven component, said resilient means generating a side force against said driven component.

10. A luminaire system, comprising:

a light source;

a light beam parameter changing mechanism for altering a light beam emanating from said light source; at least a portion of said light beam parameter changing mechanism being disposed along a path of said light beam; said light beam parameter changing mechanism comprising a plurality of rotatable optical elements and a drive mechanism interconnecting said rotatable optical elements; said light beam parameter changing mechanism further comprising a backlash minimizer having a preloaded bearing assembly operatively associated with said plurality of rotatable optical elements, said backlash minimizer comprising a plurality of spur gears, a plurality of springs and a ring including a series of gear teeth in engagement with said spur gears, said plurality of springs disposed circumferentially on said ring so that a side force is generated against said spur gears.

11. A method of creating repeatable color in a luminaire to match companion lighting instruments, comprising:

linking a plurality of radially disposed filter assemblies within a luminaire bulkhead to a plurality of spur gears interconnected by a drive mechanism;

applying a side force against said spur gears through a series of cantilevered springs to said drive mechanism to remove backlash from the spur gears;

providing an interference fit between said spur gears and a filter carrier to allow the spur gears to slip when the filter carrier hits a stop in a first direction of travel; and reversing the direction of travel so that the filter carrier moves in an opposite direction to a stop in a second direction of travel, said second direction of travel being opposite to said first direction of travel for automatically registering said plurality of filters.

12. A lighting instrument comprising a housing having a longitudinal axis, a light source disposed at one end of the housing for projecting a beam of light through said housing in the direction of the longitudinal axis, at least one set of light modifying elements disposed generally radially about said longitudinal axis, and a drive mechanism coupled to each light modifying element for rotating each said element about an axis of rotation generally transverse to said longitudinal axis; said drive mechanism comprising:

a plurality of carriers each including a clip for supporting said light modifying element and a shaft for rotating said element about said axis of rotation;

a structure supporting said carriers and said elements in generally radial arrangement about said longitudinal axis;

a spur gear mounted to one end of each shaft, each spur gear being coupled to a ring gear for concomitant rotation of said plurality of carriers;

the improvement comprising a clutch section characterized by a friction fit between each said shaft and its corresponding spur gear, and further comprising stop means provided on said structure to limit rotation of each said carrier for automatically registering said light modifying elements.

13. A lighting instrument comprising a housing having a longitudinal axis, a light source disposed at one end of the housing for projecting a beam of light though said housing in the direction of the longitudinal axis, at least one set of light modifying elements disposed generally radially about said longitudinal axis, and a drive mechanism coupled to each light modifying element for rotating each said element about an axis of rotation generally transverse to said longitudinal axis; said drive mechanism comprising:

a plurality of carriers each including a clip for supporting said light modifying element and a shaft for rotating said element about said axis of rotation;

a structure supporting said carriers and said elements in generally radial arrangement about said longitudinal axis;

a spur gear mounted to one of each shaft, each spur gear being coupled to a ring gear for concomitant rotation of said plurality of carriers;

the improvement comprising resilient means for maintaining gear mesh between said spur gears and said ring gear.

14. A lighting instrument having multiple adjustable parameters, said lighting instrument comprising a lamp housing enclosing a light source and a reflector forming a light beam, said lamp housing being pivotally mounted to a support structure providing adjustment of said lamp housing with respect to azimuth and elevation, said support structure comprising:

a motor housing enclosing a motor having a drive shaft, said motor having a drive pulley affixed to said shaft;

an axle assembly including bearings;

a driven pulley affixed to one of said axle;

a drive belt coupling said drive pulley to said driven pulley;

the improvement comprising a resilient element forming one flange of said driven pulley, said resilient element providing a pre-load tension on said bearings.

* * * * *